United States Patent [19]

Schuman

[11] 4,045,033

[45] Aug. 30, 1977

[54] GOLF PUTTING AID

[76] Inventor: Cary Schuman, 3276 Longridge Terrace, Sherman Oaks, Calif. 91423

[21] Appl. No.: 669,242

[22] Filed: Mar. 22, 1976

[51] Int. Cl.[2] ..... A63B 69/36

[52] U.S. Cl. ..... 273/188 R; 273/187 R; 272/125

[58] Field of Search ..... 273/187 R, 189 R, 188, 273/192; 272/68, 116, 117, 96, 135, 126, 141, 137; 128/80 A, 84 A, 87 C, 82, 76 R, 83

[56] References Cited

U.S. PATENT DOCUMENTS

| | | | |
|---|---|---|---|
| 1,655,092 | 1/1928 | Davis | 273/189 R |
| 1,973,240 | 9/1934 | Werness et al. | 128/83 X |
| 2,132,862 | 10/1938 | Pilates | 272/137 |
| 3,190,658 | 6/1965 | Kane | 273/192 |
| 3,384,377 | 5/1968 | Stipp | 273/187 R |
| 3,672,682 | 6/1972 | Yanagidaira | 273/189 R |
| 3,884,464 | 5/1975 | Evangelos | 272/135 |

*Primary Examiner*—George J. Marlo
*Attorney, Agent, or Firm*—Spensley, Horn & Lubitz

[57] ABSTRACT

A golf putting aid adapted to be placed between the golfer's legs comprising a rigid member having at least one pair of opposed concave side surfaces and an opposed pair of concave end surfaces for engaging the legs to maintain the legs in a plurality of substantially fixed positions to steady the golfer's stance and reduce body sway.

3 Claims, 5 Drawing Figures

GOLF PUTTING AID

BACKGROUND OF THE INVENTION

1. Field of the Invention

The invention relates to an aid for use in golf putting and, in particular, to an aid for maintaining the golfer's legs in a substantially fixed position to steady the golfer's stance and reduce body sway.

2. Prior Art

In golfing, one of the most difficult techniques to learn is the art of putting. The golfer in putting must assume and maintain a comfortable and stable posture and must control his swing so that the stroke of the club will be uniform and accurate.

Various mechanical aids have been used in the past to help golfers learn how to putt accurately and consistently.

While these devices may provide some assistance in putting, they have been found to be of no assistance in steadying the golfer's stance and in reducing the swaying of the golfer's body.

Accordingly, it is a general object of the present invention to provide an improved aid for golf putting.

It is another object of the present invention to provide an improved golf putting aid which will steady the golfer's stance and reduce body sway.

It is yet another object of the present invention to provide an improved golf putting aid which is compact, economical and readily portable.

SUMMARY OF THE INVENTION

A golf putting aid adapted to be placed between the golfer's legs is provided. The aid comprises a rigid member having at least one pair of opposed surfaces for engaging the legs to maintain the legs in a substantially fixed position. In one embodiment of the invention, the member is generally cylindrical in shape and has opposed indentations in the surface for receiving and frictionally engaging the golfer's legs. In another embodiment of the invention, the member comprises two concave surfaces joined by a rigid but slidably adjustable tube, the surfaces being adapted to frictionally engage the legs of the golfer.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only and are not intended as a definition of the limits of the invention.

DETAILED DESCRIPTION OF THE INVENTION

Figure 1:
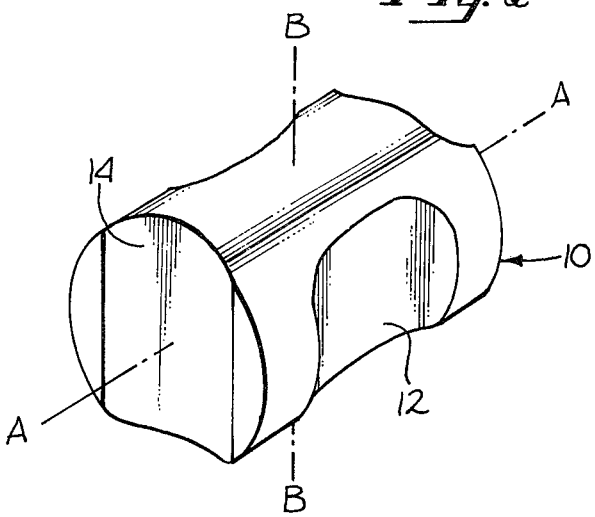
FIG. 1 is a perspective view of a preferred embodiment of the present invention.

In FIG. 1 a preferred embodiment of the invention is illustrated. The invention comprises a generally cylindircal shaped body 10 which is composed of a rigid lightweight material such as a plastic foam. The body 10 has a pair of opposed surfaces 12 concavely formed therein to engage the legs of the golfer. The surfaces 12 may be textured so as to frictionally engage the golfer's legs or may have a layer of a material bonded thereto which has a high coefficient of friction, such as a dimpled layer of soft rubber. The body 10 is shown as also having a second pair of opposed surfaces 14 formed therein but spaced a different distance apart than surfaces 12 so as to accommodate a wider stance of the golfer.

Figure 2:
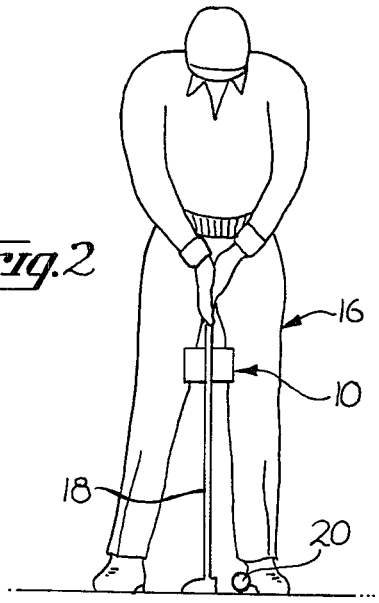
FIG. 2 is a sketch illustrating a manner in which the present invention is used for its intended purpose.

As shown in FIG. 2, the body 10 is placed between the legs 16 of the golfer at a position generally right above the knees and the golfer positions his legs 16 such that the surfaces 12 or 14 frictionally engage both of his legs. The body 10 and the legs 16 remain in this engaged position the entire time the golfer draws the putter 18 back, strokes the ball 20 and follows through. The body 10 in engagement with the legs 16 causes the legs 16 of the golfer to remain in a substantially fixed position and thus steadies the golfer's stance and reduces body sway. In addition, because of the nature of the body 10, the legs 16 are placed when in engagement with the surfaces 12 in a position found to be most suitable for a putting stance.

Figure 3:
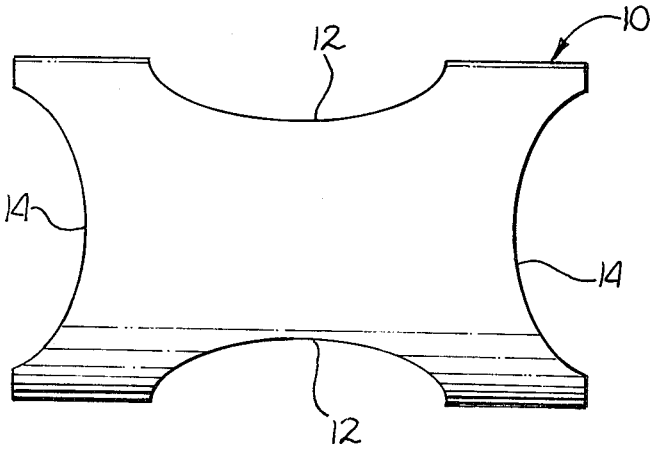
FIG. 3 is a cross section view of the present invention of FIG. 1 along the lines A—A.

In FIG. 3 a cross section view of the body 10 is illustrated along the lines A—A of FIG. 1. In a particular embodiment the body 10 is 10 inches long and 6 inches in diameter. The surfaces 12 are 3½ inches apart and are concavely indented in the body 10, 1¼ inches into opposing sides of the body 10. The surfaces 14 are 7½ inches apart and are concavely indented 1¼ inches into opposing ends of the body 10.

Figure 4:
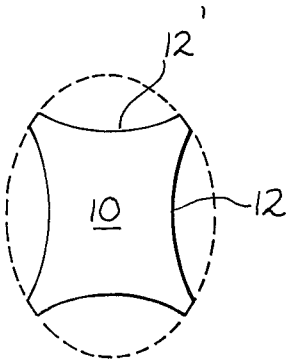
FIG. 4 is a cross-sectional view of a variation of the invention of FIG. 1 along the lines B—B.

In FIG. 4, a cross-sectional view of a modified embodiment of the body 10 is illustrated along the lines B—B of FIG. 1. The cross section of the body 10 instead of being circular as would be the case for a cylinder is now shown as elliptical in shape and a third pair of opposed surfaces 12' are concavely formed in the body 10 spaced along the major axis of the ellipse so as to provide another spaced-apart position for the legs of the golfer.

Figure 5:
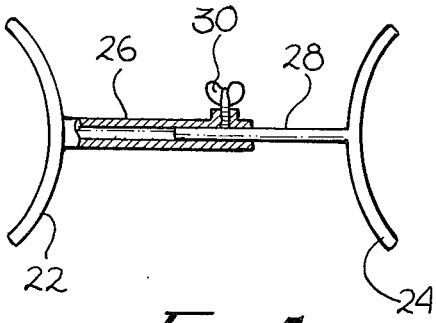
FIG. 5 is a prospective view of an alternate embodiment of the present invention.

In FIG. 5 an alternate embodiment of the present invention is shown in which a pair of concavely shaped opposed surfaces 22 and 24 are joined by a hollow tube 26 coupled to the surface 22 into which is inserted a rod 28 coupled to the opposed surface 24. The tube 26 and the rod 28 are locked relative to one another by a thumbscrew 30 after a suitable distance between the opposed surfaces 22 and 24 has been determined. The structure forms, as in the previous embodiment, a rigid body having a pair of opposed surfaces for engaging the golfer's legs to maintain such legs in a substantially fixed position and thus steady the golfer's stance and reduce body sway.

Having thus described the invention, it is obvious that numerous modifications and departures may be made by those skilled in the art; thus the invention is to be construed as being limited only by the spirit and scope of the appended claims.

What is claimed is:

1. A golf putting aid configured to be placed between the golfer's legs comprising an elongated rigid member having a first pair of opposed concave indentations of equal curvature in the side surfaces of said member for receiving said legs to maintain said legs spaced apart in a substantially fixed putting position, and a second pair of opposed, concave leg receiving indentations of equal curvature positioned in the ends of said member and spaced a different distance apart than said first pair of concave indentations to provide the golfer a second leg spacing position upon the spatial rotation of said member.

2. The putting aid of claim 1 wherein the surfaces of said indentations include means for frictionally engaging said legs to prevent the slippage thereof.

3. The putting aid of claim 1 wherein said member comprises a plastic material.

* * * * *